US011784431B2

(12) United States Patent
Miyamura

(10) Patent No.: US 11,784,431 B2
(45) Date of Patent: Oct. 10, 2023

(54) CONNECTOR WITH TERMINAL FITTING AND LOCK ARM

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventor: Tetsuya Miyamura, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 390 days.

(21) Appl. No.: 17/277,464

(22) PCT Filed: Sep. 12, 2019

(86) PCT No.: PCT/JP2019/035801
§ 371 (c)(1),
(2) Date: Mar. 18, 2021

(87) PCT Pub. No.: WO2020/071077
PCT Pub. Date: Apr. 9, 2020

(65) Prior Publication Data

US 2022/0037825 A1 Feb. 3, 2022

(30) Foreign Application Priority Data

Oct. 1, 2018 (JP) ..... 2018-186497
Nov. 22, 2018 (JP) ..... 2018-218860

(51) Int. Cl.
*H01R 13/42* (2006.01)

(52) U.S. Cl.
CPC ..... *H01R 13/42* (2013.01)

(58) Field of Classification Search
CPC .. H01R 13/42; H01R 13/6272; H01R 13/641; H01R 13/4367
See application file for complete search history.

(56) References Cited

U.S. PATENT DOCUMENTS 5,876,244 A 3/1999 Tabata
9,614,314 B2 * 4/2017 Chikusa ..... H01R 13/629
(Continued)

FOREIGN PATENT DOCUMENTS

JP H1032037 A * 2/1998 ..... H01R 13/5221
JP H11-067318 A 3/1999
(Continued)

OTHER PUBLICATIONS

International Search Report dated Nov. 12, 2019 for WO 2020/071077 A1 (4 pages).

*Primary Examiner* — Abdullah A Riyami
*Assistant Examiner* — Nader J Alhawamdeh
(74) *Attorney, Agent, or Firm* — Venjuris, P.C.

(57) ABSTRACT

It is aimed to prevent the interference of an external matter with an operating portion of a lock arm. A female connector (10) includes a female housing (11), female terminal fittings (26) to be inserted into the female housing (11) from behind, and a retainer (33) to be mounted into the female housing (11). The female housing (11) includes a lock arm (17) having a rear end part serving as an operating portion (20) for unlocking, and the retainer (33) is formed with a covering portion (35) for covering at least a part of the operating portion (20).

4 Claims, 13 Drawing Sheets

(56) References Cited

U.S. PATENT DOCUMENTS

| | | | | |
|---|---|---|---|---|
| 2002/0025713 | A1 | 2/2002 | Tabata | |
| 2016/0365664 | A1* | 12/2016 | Chikusa | H01R 13/422 |

FOREIGN PATENT DOCUMENTS

| | | | |
|---|---|---|---|
| JP | 2006-269198 | A | 10/2006 |
| JP | 2007-305484 | A | 11/2007 |
| JP | 2008-147074 | A | 6/2008 |

* cited by examiner

CONNECTOR WITH TERMINAL FITTING AND LOCK ARM

CROSS REFERENCE TO RELATED APPLICATIONS

This application is a national phase of PCT application No. PCT/JP2019/035801, filed on 12 Sep. 2019, which claims priority from Japanese patent application Nos. 2018-186497 and 2018-218860 filed on 1 Oct. 2018 and 22 Nov. 2018, respectively, all of which are incorporated herein by reference.

TECHNICAL FIELD

The present disclosure relates to a connector.

BACKGROUND

Patent Document 1 discloses a connector with a housing, a terminal fitting and a retainer. The terminal fitting is inserted into the housing from behind the housing. The retainer is assembled into a rear end part of the housing after the terminal fitting is inserted. With the retainer assembled, a removable locking portion of the retainer comes into contact with the terminal fitting from behind, whereby the terminal fitting is held in a retained state. In connecting this connector to a mating connector, an operation is easily performed by pushing the rear surface of the retainer with a finger.

PRIOR ART DOCUMENT

Patent Document

Patent Document 1: JP H11-067318 A

SUMMARY OF THE INVENTION

Problems to be Solved

It is possible to adopt a structure for locking both connectors in a connected state by a locking action of a lock arm when the connector is connected to the mating connector by providing the lock arm on an outer surface of a housing in a connector of this type. In this case, an operating portion for unlocking is arranged on a rear end part of the housing. Thus, there is a possibility that a finger contacts the operating portion to deflect the operating portion in an unlocking direction when a connecting operation is performed while the rear surface of the retainer is pushed with the finger. If this occurs, a click feeling due to the resilient return of the lock arm cannot be felt when the both connectors are properly connected, and whether or not the both connectors have been properly connected cannot be discriminated.

The present disclosure was completed on the basis of the above situation and aims to prevent the interference of an external matter with an operating portion of a lock arm.

Means to Solve the Problem

The present disclosure is directed to a connector with a housing, a terminal fitting to be inserted into the housing from behind, and a rear member to be mounted into the housing, wherein the housing includes a lock arm having a rear end part serving as an operating portion for unlocking, and the rear member is formed with a covering portion for covering at least a part of the operating portion.

Effect of the Invention

According to the present disclosure, it is possible to prevent the interference of an external matter with the operating portion of the lock arm.

DETAILED DESCRIPTION TO EXECUTE THE INVENTION

Description of Embodiments of Present Disclosure

Figure 1:
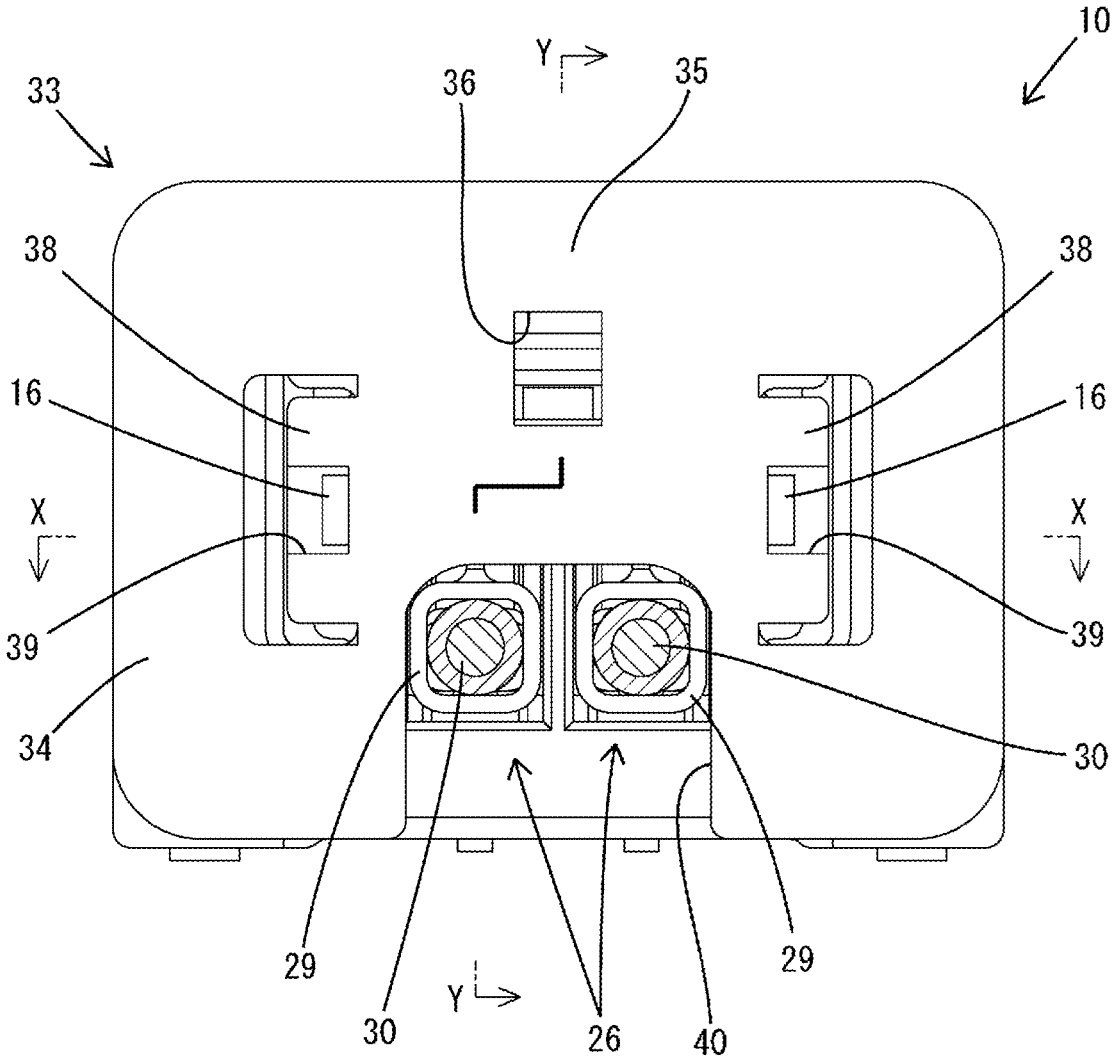
FIG. 1 is a back view showing a state where a female connector of a first embodiment is connected to a male connector.
Figure 2:
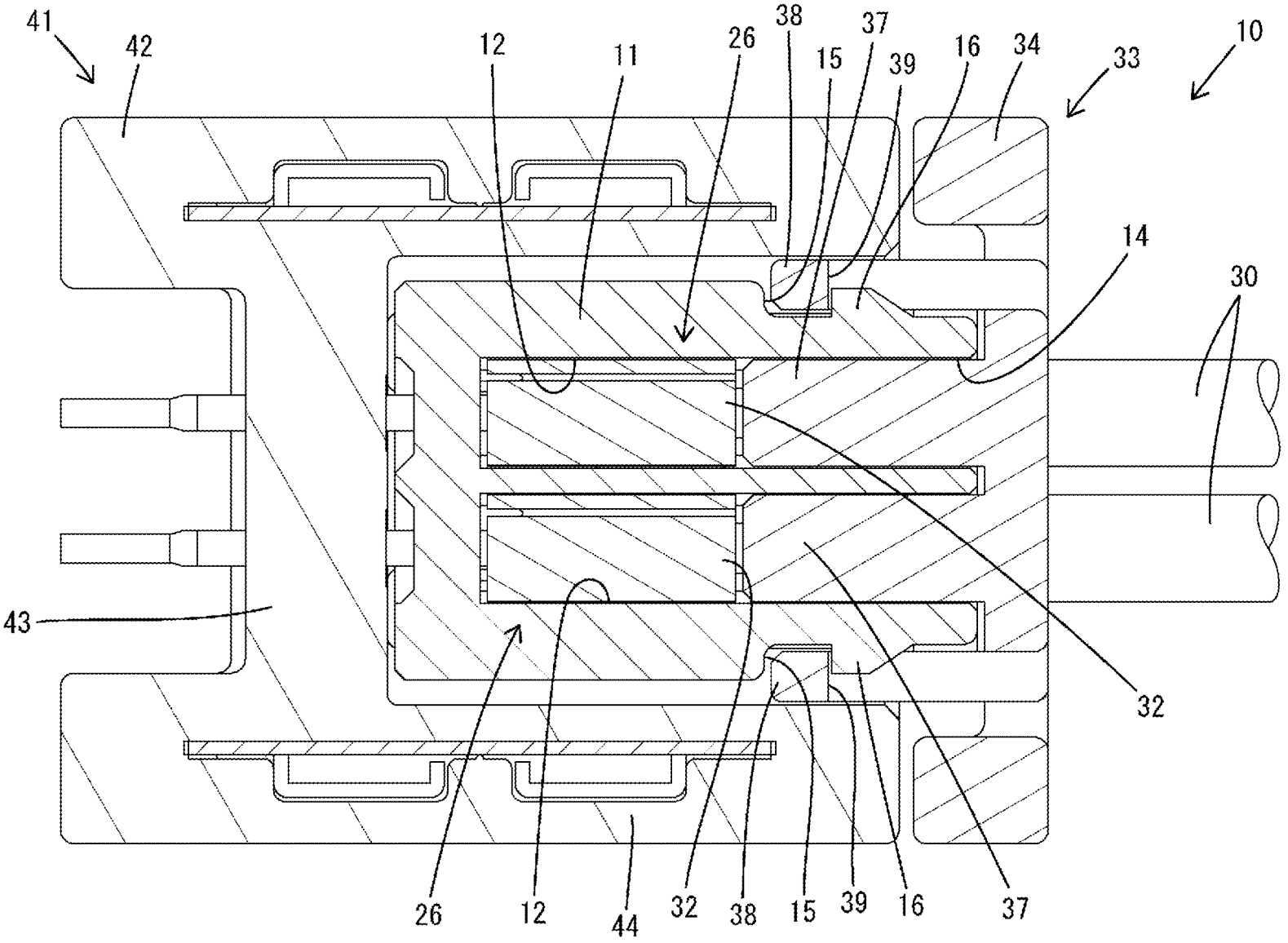
FIG. 2 is a section along X-X of FIG. 1.

First, embodiments of the present disclosure are listed and described.

(1) The connector of the present disclosure includes a housing, a terminal fitting to be inserted into the housing from behind, and a rear member to be mounted into the housing, wherein the housing includes a lock arm having a rear end part serving as an operating portion for unlocking, and the rear member is formed with a covering portion for covering at least a part of the operating portion.

According to the present disclosure, since the operating portion of the lock arm is covered by the covering portion of the rear member, there is no possibility that a finger contacts the operating portion when a connecting operation or the like is performed with the finger placed in contact with the rear member. Therefore, the interference of external matters with the operating portion of the lock arm can be prevented.

(2) Preferably, the rear member functions as a retainer for holding the terminal fitting in a retained state by being mounted into the rear end part of the housing.

(3) Preferably, the rear member is formed with an operating hole, and the operating hole is formed such that a jig for displacing the operating portion in an unlocking direction is passable therethrough. According to this configuration, even if the operating portion cannot be operated with a finger in displacing the lock arm in the unlocking direction, the lock arm can be displaced in the unlocking direction by operating the operating portion with the jig inserted through the operating hole.

(4) Preferably, the rear member includes an inner wall portion facing a rear surface of the housing and an outer wall portion located behind the inner wall portion, and the operating holes are formed in the inner wall portion and the outer wall portion. According to this configuration, the orientation of the jig can be stabilized by two operating holes formed in the inner wall portion and the outer wall portion.

(5) Preferably, the rear member is formed with a wall portion facing a rear surface of the housing, the wall portion is formed with a retaining projection projecting forward from the wall portion and configured to come into contact with the terminal fitting from behind, and the wall portion is formed with a pair of resilient locking pieces projecting forward from a pair of outer edge parts of the wall portion and to be locked to locking projections on an outer surface of the housing.

According to this configuration, if the terminal fitting is pulled rearward to push the retaining projection rearward, the wall portion is curved, wherefore the pair of resilient locking pieces are displaced to be pressed against the outer surface of the housing. In this way, locking margins of the resilient locking pieces and the locking projections increase or locking forces of the resilient locking pieces for locking the locking projections increase. Therefore, there is no possibility that the rear member is separated from the housing, and the terminal fitting can be reliably retained.

(6) Preferably, the housing is formed with a protecting portion circumferentially extending to surround the operating portion, and the covering portion is in such a positional relationship as to closely face or come into contact with a rear surface of the protecting portion. According to this configuration, it is possible to prevent the interference of an external matter with the operating portion through a clearance between the rear surface of the protecting portion and the front surface of the covering portion.

Details of Embodiments of Present Disclosure

First Embodiment

Hereinafter, a first specific embodiment of the present disclosure is described with reference to FIGS. 1 to 9. Note that the present invention is not limited to these illustrations and is intended to be represented by claims and include all changes in the scope of claims and in the meaning and scope of equivalents. In the following description, a left side in FIGS. 2 to 5 and 8 is defined as a front side concerning a front-rear direction. Upper and lower sides shown in FIGS. 1 and 3 to 8 are directly defined as upper and lower sides concerning a vertical direction.

A female connector 10 (connector as claimed) of the first embodiment includes a female housing 11 (housing as claimed) made of synthetic resin, a pair of female terminal fittings 26 (terminal fitting as claimed) and a retainer 33 (rear member as claimed) made of synthetic resin.

The female housing 11 is in the form of a block as a whole. A pair of terminal accommodation chambers 12 are formed laterally side by side in the female housing 11. A locking lance 13 resiliently deformable in the vertical direction is formed in the lower surface of the terminal accommodation chamber 12. The rear end of the terminal accommodation chamber 12 is open as a terminal insertion opening 14 in the rear end surface of the female housing 11. A pair of left and right guide recesses 15 open in the rear end surface of the female housing 11 are formed in both left and right outer side surfaces of the female housing 11. A pair of left and right locking projections 16 are formed in the pair of guide recesses 15.

The female housing 11 is integrally formed with a lock arm 17 disposed along the upper surface (outer surface) thereof. The lock arm 17 includes an arm body portion 18 elongated in the front-rear direction along the upper surface of the female housing 11, a supporting portion 19 extending downward from a front end part of the arm body portion 18 and connected to the upper surface of the female housing 11, and a locking portion 20 for unlocking formed on a rear end part of the arm body portion 18. The lock arm 17 is resiliently deformable in the vertical direction with the supporting portion 19 as a fulcrum. A lock projection 21 is formed on the upper surface of the arm body portion 18.

The operating portion 20 is formed to project upward from a rear end part of the upper surface of the arm body portion 18. The operating portion 20 is formed with a hooking hole 22 penetrating in the front-rear direction. If a downward external force or pressing force acts on the operating portion 20, the lock arm 17 is displaced in an unlocking direction (downward).

The female housing 11 is formed with a protecting portion 23 for protecting the operating portion 20 from external matters. The protecting portion 23 is composed of an upper surface protecting portion 24 for covering the upper surface of the operating portion 20 and a pair of side surface protecting portions 25 for covering both left and right side surfaces of the operating portion 20. The protecting portion 23 prevents only the interference of external matters with the operating portion 20 from above and the interference of external matters with operating portion 20 from both lateral sides. The protecting portion 23 and the female housing 11 are not formed with a part for covering the operating portion 20 from behind. Accordingly, in a state where the retainer 33 is not mounted in the female housing 11, the operating portion 20 is exposed rearwardly of the female housing 11.

The female terminal fitting 26 includes a rectangular tube portion 27 in a front end part and a crimping portion 29 in the form of an open barrel in a rear end part. A resilient contact piece 28 is accommodated in the rectangular tube portion 27. A projection-like primary locking portion 31 is formed on the lower surface of the rectangular tube portion 27. A step portion on the rear end of the rectangular tube portion 27 serves as a secondary locking portion 32. The crimping portion 29 is conductively crimped to a coated wire 30.

The female terminal fitting 26 is inserted into the terminal accommodation chamber 12 from behind the female housing 11. The properly inserted female terminal fitting 26 is held in a retained state by having a projection part thereof locked by the locking lance 13. The coated wire 30 fixed to the female terminal fitting 26 is drawn out to a rear side of the female housing 11.

The retainer 33 is a single component including a wall portion 34 orthogonal to an inserting direction of the female terminal fittings 26 into the female housing 11, a pair of left and right retaining projections 37 and a pair of left and right resilient locking pieces 38. The wall portion 34 has a substantially rectangular shape and has a size to cover the entire rear surface of the female housing 11 in a back view. The wall portion 34 is formed with an escaping recess 40 by cutting a region corresponding to the plurality of terminal accommodation chambers 12 in a back view. The escaping recess 40 is open in the lower end edge of the wall portion 34.

A part of the wall portion 34 functions as a covering portion 35. Specifically, a laterally central part of the wall portion 34 above a center height in the vertical direction constitutes the covering portion 35. In other words, a region of the wall portion 34 corresponding to the entire operating portion 20 of the lock arm 17 and a region surrounding the region corresponding to the operating portion 20 (region corresponding to the protecting portion 23) in a back view serve as the covering portion 35. That is, the covering portion 35 is formed to cover the entire operating portion 20 from behind in a back view.

An operating hole 35 penetrating in the front-rear direction (thickness direction of the wall portion 34) is formed in the region of the wall portion 34 constituting the covering portion 35. The operating hole 36 is a large rectangular opening formed in a wide region of the operating portion 20 including the entire opening region of the hooking hole 22 in a back view. An upper end edge in the opening region of the operating hole 36 is located substantially at the same height as the upper end of the hooking hole 22 when the lock arm 17 is in a free state without being resiliently deflected. A lower end edge in the opening region of the operating hole 36 is located substantially at the same height as the lower end of the hooking hole 22 when the lock arm 17 is resiliently deflected and displaced in the unlocking direction.

The pair of left and right retaining projections 37 are cantilevered forward from the front surface (surface facing the rear surface of the female housing 11) of the wall portion 34. The pair of retaining projections 37 are disposed at positions corresponding to upper end parts of the pair of terminal accommodation chambers 12 in the vertical and lateral directions. Specifically, the pair of retaining projections 37 are disposed at positions corresponding to the secondary locking portions 32 of the female terminal fittings 26 in a back view. The pair of retaining projections 37 are disposed at positions closer to a center than to both left and right ends (pair of resilient locking pieces 38) of the wall portion 34 in the lateral direction.

The pair of left and right resilient locking pieces 38 are cantilevered forward from both left and right side edges of the wall portion 34. The resilient locking piece 38 has a substantially rectangular shape in a side view. The resilient locking piece 38 is formed with a locking hole 39 penetrating in the lateral direction. The resilient locking piece 38 is resiliently deformable in the lateral direction.

The retainer 33 is assembled into the rear end part of the female housing 11 after the female terminal fittings 26 are inserted into the female housing 11. In assembling, the escaping recess 40 is fit from above to regions of the coated wires 30 drawn out rearwardly of the female housing 11, and the retainer 33 is brought closer to the female housing 11 from behind while the resilient locking pieces 38 are fit into the guide recesses 15. As the retainer 33 is brought closer, the retaining projections 37 are inserted into the terminal accommodation chambers 12.

When the retainer 33 reaches a properly assembled state, the locking holes 39 of the resilient locking pieces 38 are locked to the locking projections 16, whereby the retainer 33 is locked in an assembled state with respect to the female housing 11. Further, the retaining projections 37 come into contact with the secondary locking portions 32 of the female terminal fittings 26 from behind or approach to face the secondary locking portions 32 from behind. Accordingly, if an attempt is made to displace the female terminal fitting 26 rearward, the secondary locking portion 32 contacts the retaining projection 37, whereby a displacement of the female terminal fitting 26 in a withdrawing direction is restricted. In the above way, the female terminal fittings 26 are reliably held in the retained state by a primary locking action by the locking lances 13 and a secondary locking action by the retainer 33.

Further, with the retainer 33 properly assembled in the female housing 11, the covering portion 35 covers the entire operating portion 20 of the lock arm 17 from behind. Accordingly, even if an external matter approaches the operating portion 20 from behind, there is no possibility that that external matter contacts the operating portion 20. Further, the covering portion 35 is arranged in proximity to the rear surface of the protecting portion 23 in the front-rear direction. Thus, there is no possibility that any external matter intrudes through a clearance between the front surface of the covering portion 35 and the rear surface of the protecting portion 23.

The female connector 10 is connectable to a male connector 41. The male connector 41 functions as a board connector to be mounted on a circuit board (not shown). The male connector 41 includes a male housing 42 and a pair of male terminal fittings 47 mounted in the male housing 42. The male housing 42 includes a wall-like terminal through portion 43 and a receptacle 44 in the form of a rectangular tube projecting toward a front surface side (toward the female connector 10) from the outer peripheral edge of the terminal through portion 43. An upper surface portion 45 constituting the receptacle 44 is formed with a lock hole 46. The male terminal fittings 47 are passed through the terminal through portion 43, tabs 48 on the tips of the male terminal fittings 47 are accommodated into the receptacle 44, and board connecting portions 49 of the male terminal fittings 47 are fixed to the circuit board by soldering.

Figure 3:
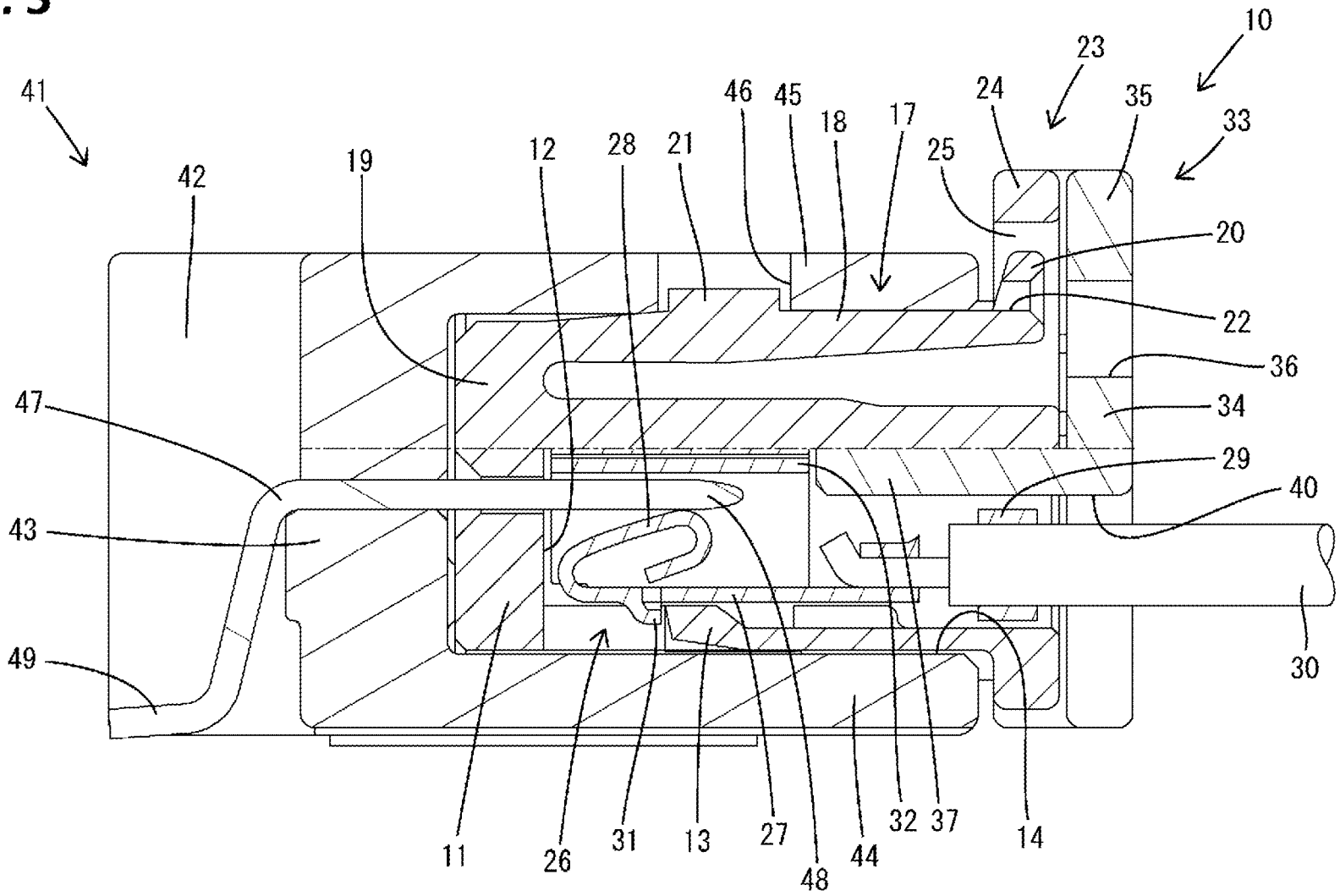
FIG. 3 is a section along Y-Y of FIG. 1.

In connecting the female connector 10 to the male connector 41, the front surfaces of the female connector 10 (female housing 11) and male connector 41 (male housing 42) are brought closer while facing opposite to each other, and the female housing 11 is fit into the receptacle 44. In the process of connecting the female connector 10 to the male connector 41, the lock projection 21 interferes with the upper surface portion 45 of the receptacle 44, whereby the lock arm 17 is resiliently deflected downward. When the both connectors 10, 41 reach a properly connected state, the lock arm 17 resiliently returns and the lock projection 21 is locked into the lock hole 46. By this locking of the lock projection 21 and the lock hole 46, the both connectors 10, 41 are locked in a connected state as shown in FIG. 3.

If a worker connects the both connectors 10, 41 while pinching the operating portion 20 by fingers and removes the fingers from the operating portion 20 after this operation, the lock arm 17 does not swiftly resiliently return, wherefore the arm body portion 18 does not collide with the upper surface portion 45 of the receptacle 44. Thus, even if the both connectors 10, 41 reach the properly connected state, no impact sound is generated and an impact (click feeling) due to a collision is not transferred to the worker pinching the female connector 10. Therefore, the worker cannot judge whether or not the both connectors 10, 41 have been properly connected.

As a countermeasure against this, the retainer 33 is formed with the covering portion 35 for covering the operating portion 20 from behind in the first embodiment. In this way, even if the wall portion 34 of the retainer 33 is pushed from behind with a finger in pushing the female connector 10 into the receptacle 44 of the male connector 41, there is no possibility that the finger contacts the operating portion 20. Accordingly, when the both connectors 10, 41 reach the properly connected state, the lock arm 17 invariably resiliently returns upward by a resilient restoring force of the lock arm 17 and the upper surface of the arm body portion 18 reliably collides with the upper surface portion 45 of the receptacle 44. By this collision, an impact sound is generated and an impact (click feeling) due to a collision is transferred to the worker pinching the female connector 10.

By these impact sound and click feeling, the worker can judge that the both connectors 10, 41 have been properly connected.

Figure 4:
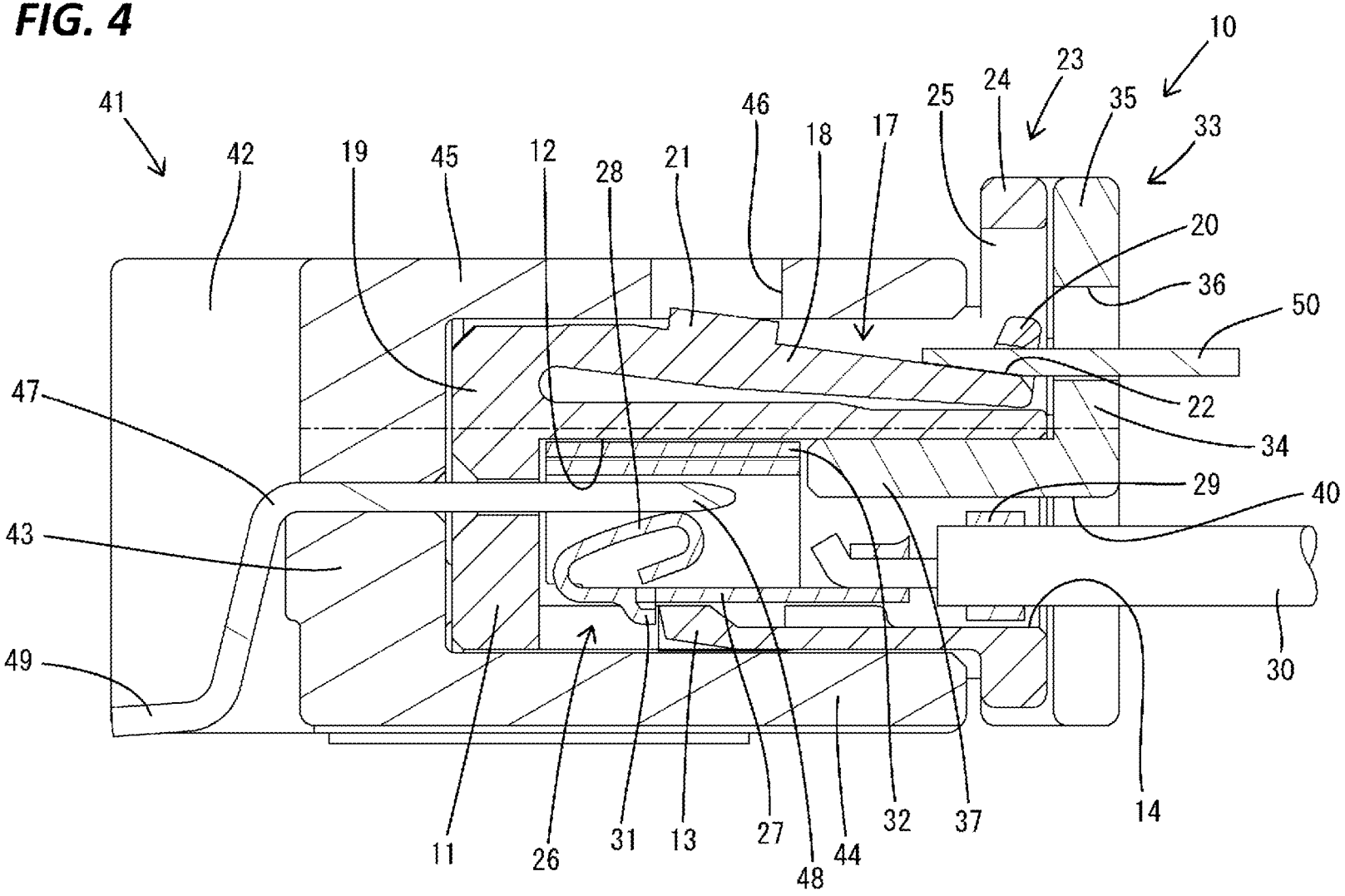
FIG. 4 is a section along Y-Y showing a state where a lock arm is displaced in an unlocking direction by a jig.
Figure 5:
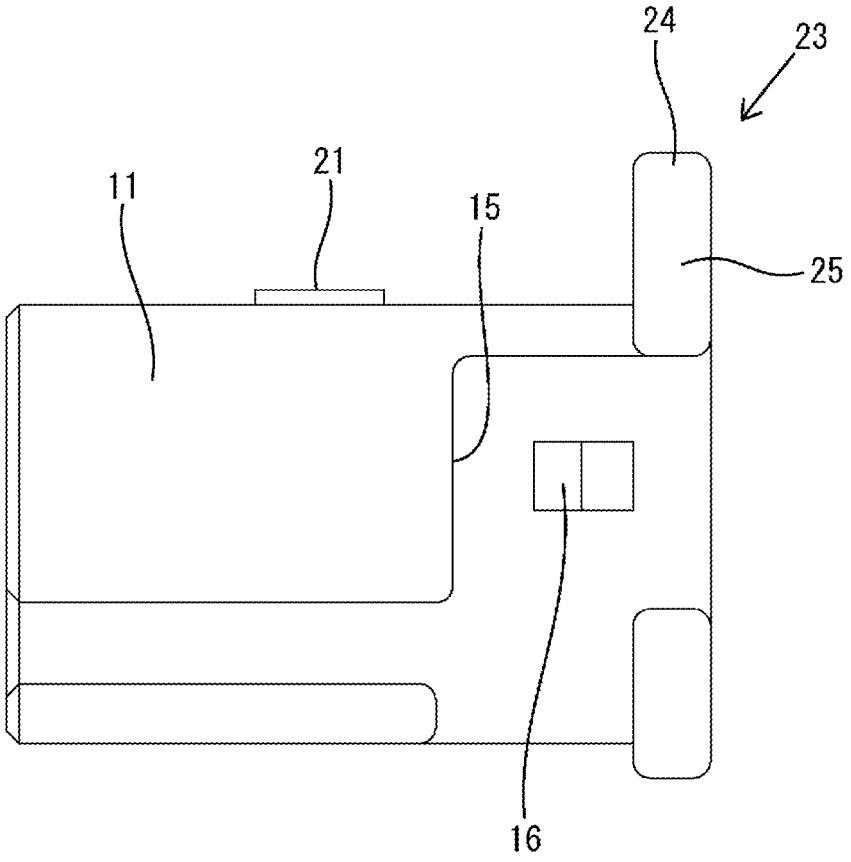
FIG. 5 is a side view of a female housing.
Figure 6:
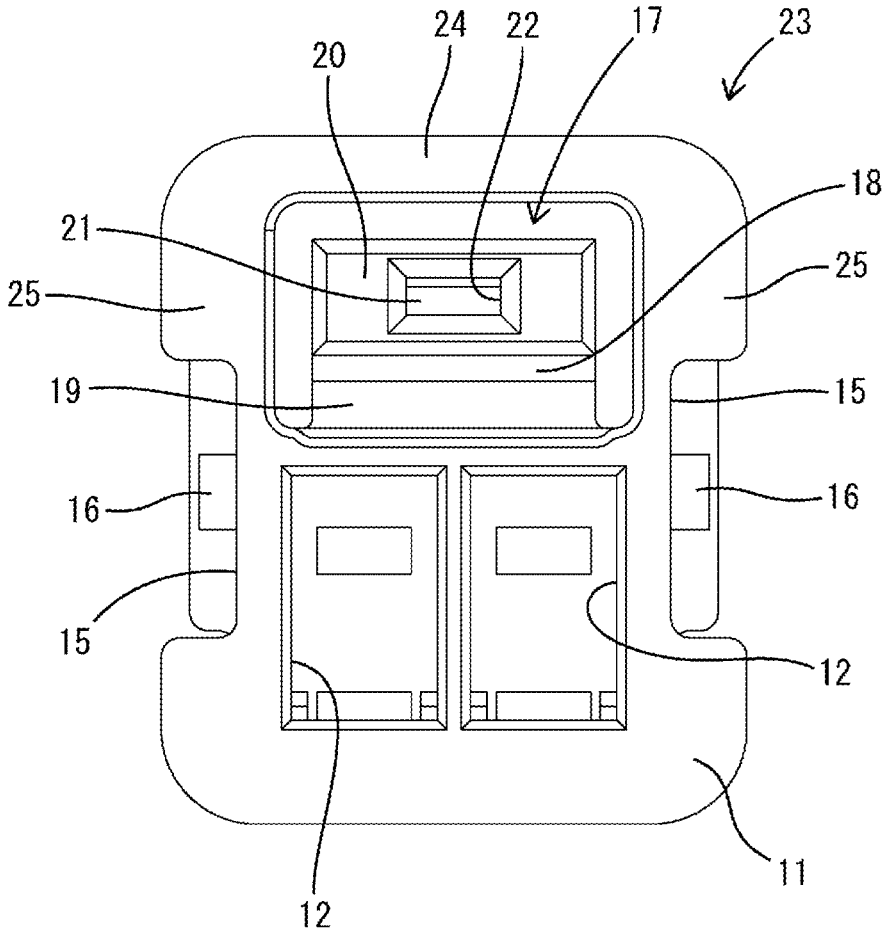
FIG. 6 is a back view of the female housing.
Figure 7:
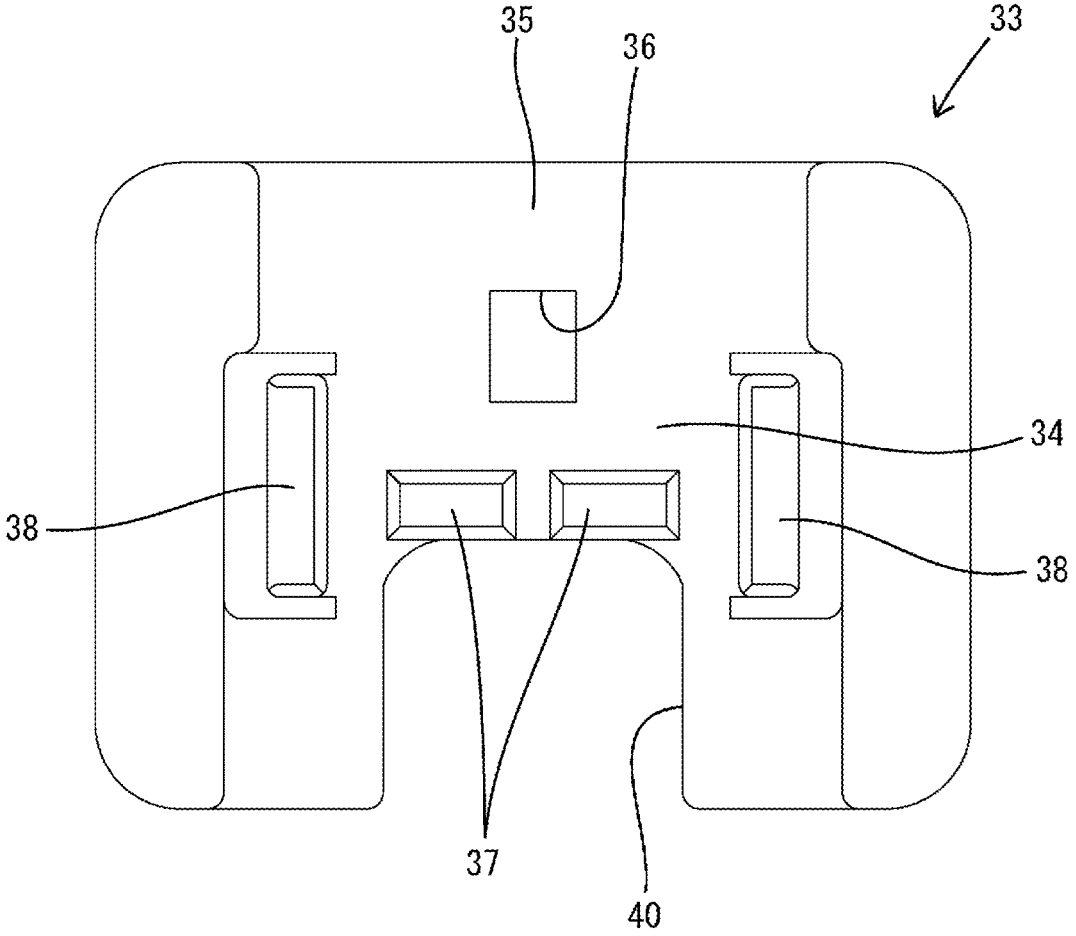
FIG. 7 is a front view of a retainer.
Figure 8:
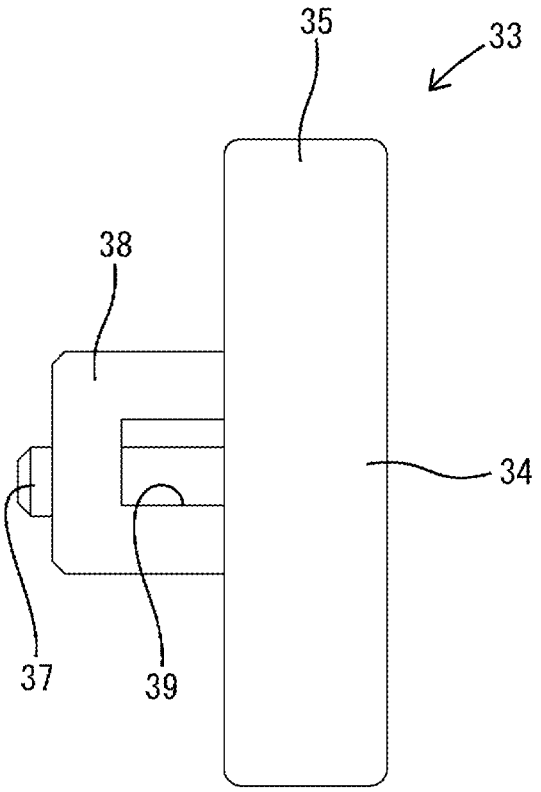
FIG. 8 is a side view of the retainer.
Figure 9:
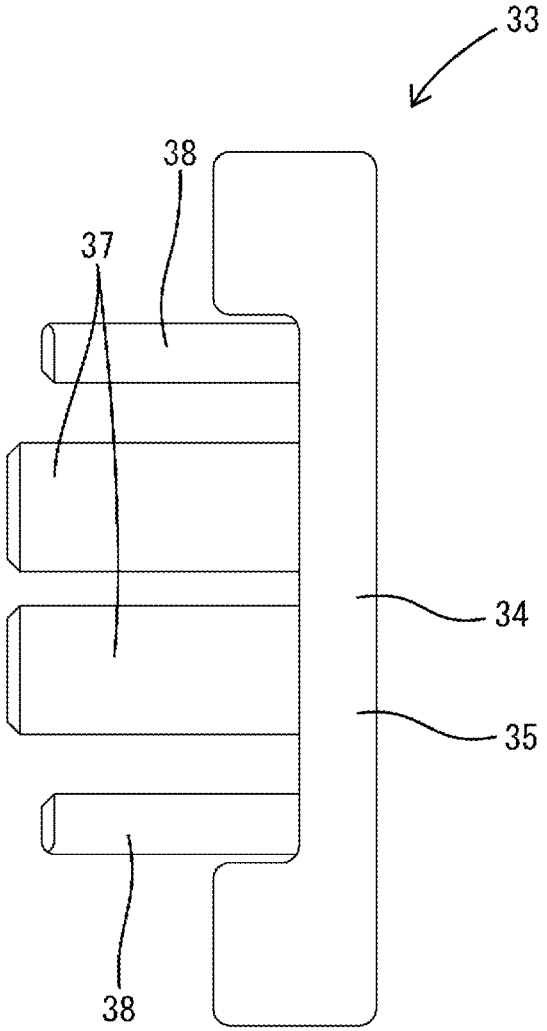
FIG. 9 is a plan view of the retainer.

In separating the both connectors 10, 41 in the connected state, a jig 50 is passed through the operating hole 36 from behind the retainer 33 and the tip of the jig 50 is inserted into the hooking hole 22 of the operating portion 20. If a tip part of the jig 50 is then displaced downward, the lock arm 17 is resiliently deflected in the unlocking direction as shown in FIG. 4, wherefore the lock projection 21 is disengaged from the lock hole 46 and the locked state of the both connectors 10, 41 is released. Thereafter, the female connector 10 may be pulled out from the receptacle 44 with a lock released state maintained.

The connector of the first embodiment includes the female housing 11, the female terminal fittings 26 and the retainer 33. The female housing 11 is formed with the lock arm 17. The rear end part of the lock arm 17 serves as the operating portion 20 for unlocking. The female terminal fittings 26 are inserted into the female housing 11 from behind. The retainer 33 is mounted into the rear end part of the female housing 11, thereby exhibiting a function of holding the female terminal fittings 26 in the retained state.

The retainer 33 is formed with the covering portion 35 for covering at least a part of the operating portion 20 from behind. According to this configuration, since the operating portion 20 of the lock arm 17 is covered by the covering portion 35 of the retainer 33, there is no possibility that a finger pushing the retainer 33 contacts the operating portion 20 in connecting the female housing 11 and the male housing 42 (mating housing) by placing the finger in contact with the retainer 33. Also when the connecting operation of the female housing 11 and the male housing 42 is not performed, there is no possibility that fingers and external matters other than the fingers contact the operating portion 20 from behind.

Further, the retainer 33 is formed with the operating hole 36. The jig 50 can be passed through the operating hole 36. The jig 50 displaces the operating portion 20 in the unlocking direction by being passed through the operating hole 36. Even if the operating portion 20 cannot be operated with a finger in operating the lock arm 17 in the unlocking direction, the lock arm 17 can be displaced in the unlocking direction by operating the operating portion 20 with the jig 50 inserted through the operating hole 36.

Further, the retainer 33 is formed with the wall portion 34 configured to face the rear surface of the female housing 11. The wall portion 34 is formed with the retaining projections 37 and the pair of resilient locking pieces 38. The retaining projections 37 project forward from the wall portion 34, and retain the female terminal fittings 26 in the terminal accommodation chambers 12 by coming into contact with the female terminal fittings 26 from behind. The pair of resilient locking pieces 38 project forward from the pair of outer edge parts (both left and right edge parts) of the wall portion 34 and lock the retainer 33 in a state assembled with the female housing 11 by being locked to the locking projections 16 on the outer surface of the female housing 11.

According to this configuration, if the female terminal fitting 26 is pulled rearward to push the retaining projection 37 rearward, the wall portion 34 is curved with a laterally central part thereof displaced rearward. As the wall portion 34 is curved, front end parts of the pair of resilient locking pieces 38 approach each other and are displaced to be pressed against the outer surface of the female housing 11. In this way, locking margins of the resilient locking pieces 38 and the locking projections 16 increase or locking forces of the resilient locking pieces 38 for locking the locking projections 16 increase. Therefore, there is no possibility that the retainer 33 is separated from the female housing 11, and the female terminal fittings 26 can be reliably retained.

Further, the female housing 11 is formed with the protecting portion 23 circumferentially extending to surround the operating portion 20, and the covering portion 35 is in such a positional relationship as to closely face the rear surface of the protecting portion 23. According to this configuration, it is possible to prevent the interference of an external matter with the operating portion 20 through the clearance between the rear surface of the protecting portion 23 and the front surface of the covering portion 35.

Second Embodiment

Next, a second specific embodiment of the present disclosure is described with reference to FIGS. 10 to 13. A female connector 51 (connector as claimed) of the second embodiment differs from the first embodiment in the configuration of a retainer 52 (rear member as claimed). Since the other components are the same as in the first embodiment, the same components are denoted by the same reference signs and the structures, functions and effects thereof are not described.

The retainer 52 of the second embodiment is a single component and includes an outer wall portion 53, an upper surface wall portion 54, a pair of left and right side surface wall portions 55 and an inner wall portion 56 parallel to the outer wall portion 43. The outer wall portion 53 is orthogonal to an inserting direction of female terminal fittings 26 (terminal fitting as claimed) into a female housing 11 (housing as claimed). The retainer 52 further includes a pair of left and right retaining projections 58 and a pair of left and right resilient locking pieces 59.

The outer wall portion 53 has a substantially rectangular shape in a back view and has a size to cover the entire rear surface of the female housing 11. The upper surface wall portion 54 extends forward substantially at a right angle from the upper edge of the outer wall portion 53. The both left and right side surface wall portions 55 extend forward substantially at a right angle from both left and right side edges of the outer wall portion 53.

The inner wall portion 56 is disposed at a position forward of the outer wall portion 53 and slightly behind the front ends of the upper surface wall portion 54 and the side surface wall portions 55. The inner wall portion 56 is formed with an escaping recess 57 by cutting a region corresponding to a plurality of terminal accommodation chambers 12 in a front view. The escaping recess 57 is open in the lower end edge of the inner wall portion 56.

The pair of left and right retaining projections 58 are cantilevered forward from the front surface (surface facing the rear surface of the female housing 11) of the inner wall portion 56. The pair of retaining projections 58 are disposed at positions corresponding to upper end parts of the pair of terminal accommodation chambers 12 in vertical and lateral directions. Specifically, the pair of retaining projections 58 are disposed at positions corresponding to secondary locking portions 32 of the female terminal fittings 26 in a back view. The pair of retaining projections 58 are disposed at positions closer to a center than to both left and right ends (pair of resilient locking pieces 59) of the inner wall portion 56 in the lateral direction.

The pair of left and right resilient locking pieces 59 are cantilevered forward from both left and right side edges of the inner wall portion 56. The resilient locking piece 59 has a substantially rectangular shape in a side view. The resilient locking piece 59 is formed with a locking hole 60 penetrating in the lateral direction. The resilient locking piece 59 is resiliently deformable in the lateral direction.

A part of the outer wall portion 53, a part of the upper surface wall portion 54 and parts of the side surface wall portions 55 function as a covering portion 61. Specifically, a laterally central part of the outer wall portion 53 above a center height in the vertical direction constitutes the covering portion 61. In other words, out of the wall portions, a region corresponding to an entire operating portion 20 of a lock arm 17 and a region surrounding the region corresponding to the operating portion 20 in a back view serve as the covering portion 61. That is, the covering portion 61 is formed to cover the entire operating portion 20 from behind in a back view. A laterally central part of the upper surface wall portion 54 also constitutes the covering portion 61. Upper end parts of the side surface wall portions 55 also constitute the covering portion 61.

Out of the outer wall portion 53, a region constituting the covering portion 61 is formed with an outer operating hole 62 penetrating in a front-rear direction (thickness direction of the outer wall portion 53). A tapered guiding surface 63 inclined to increase an opening area toward an outer surface (rear surface) side of the outer wall portion 53 is formed on an opening edge part of the outer operating hole 62. Accordingly, even if a jig 50 is displaced upward, downward, leftward or rightward in inserting the jig 50 into the outer operating hole 62 from behind the retainer 52, the jig 50 can slide in contact with the guiding surface 63, whereby the jig 50 can be reliably inserted into the outer operating hole 62.

The outer operating hole 62 is a large rectangular opening formed in a wide region of the operating portion 20 of the lock arm 17 including the entire opening region of a hooking hole 22 in a back view. The upper end edge in the opening region of the outer operating hole 62 is set at a position slightly higher than the upper end of the hooking hole 22 when the lock arm 17 is in a free state without being resiliently deflected. A lower end edge in the opening region of the outer operating hole 62 is set at a position slightly below the lower end of the hooking hole 22 when the lock arm 17 is resiliently deflected and displaced in an unlocking direction.

An inner operating hole 64 penetrating in the front-rear direction (thickness direction of the inner wall portion 56) is formed in a region of the inner wall portion 56 corresponding to the outer operating hole 62 in a front view. An opening area of the inner operating hole 64 is slightly smaller than that of the outer operating hole 62. The inner operating hole 64 is a large rectangular opening formed in a wide region of the operating portion 20 including the entire opening region of the hooking hole 22 in a back view. An upper end edge in the opening region of the inner operating hole 64 is set substantially at the same height as the upper end of the hooking hole 22 when the lock arm 17 is in a free state without being resiliently deflected. A lower end edge in the opening region of the inner operating hole 64 is set substantially at the same height as the lower end of the hooking hole 22 when the lock arm 17 is resiliently deflected and displaced in the unlocking direction.

The retainer 52 is assembled into a rear end part of the female housing 11 after the female terminal fittings 26 are inserted into the female housing 11. In assembling, the escaping recess 57 is fit from above to regions of coated wires 30 drawn out rearwardly of the female housing 11, and the coated wires 30 are bent downward inside the retainer 52 by being pressed with the lower end edge of the outer wall portion 53. In this way, the coated wires 30 drawn out rearward from the female housing 11 extend downward from the retainer 52. That is, the retainer 52 has a function as a wire cover in addition to a function of retaining the female terminal fittings 26.

Then, with the coated wires 30 bent, the retainer 52 is brought closer to the female housing 11 while the resilient locking pieces 59 are fit into guide recesses 15. As the retainer 52 is brought closer, the retaining projections 58 are inserted into the terminal accommodation chambers 12. When the retainer 52 reaches a properly assembled state, the locking holes 60 of the resilient locking pieces 59 are locked to locking projections 16, whereby the retainer 52 is locked in a state assembled with the female housing 11.

Further, the retaining projections 58 come into contact with secondary locking portions 32 of the female terminal fittings 26 from behind or approach to face the secondary locking portions 32 from behind. Accordingly, if an attempt is made to displace the female terminal fitting 26 rearward, the secondary locking portion 32 contacts the retaining projection 58, whereby a displacement of the female terminal fitting 26 in a withdrawing direction is restricted. In the above way, the female terminal fittings 26 are reliably held in a retained state by a primary locking action by locking lances 13 and a secondary locking action by the retainer 52.

Further, with the retainer 52 properly assembled in the female housing 11, the covering portion 61 covers the operating portion 20 of the lock arm 17 from behind and an oblique upper-rear side. Accordingly, even if an external matter approaches the operating portion 20 from behind or the oblique upper-rear side, there is no possibility that that external matter contacts the operating portion 20. Further, the upper surface wall portion 54 constituting the covering portion 61 is arranged in proximity to the rear surface of an upper surface protecting portion 24 of the protecting portion 23 in the front-rear direction, and the side surface wall portions 55 constituting the covering portion 61 are arranged in proximity to the rear surfaces of side surface protecting portions 25 of the protecting portion 23 in the front-rear direction. Thus, there is no possibility that any external matter intrudes through a clearance between the front surface of the covering portion 61 and the rear surface of the protecting portion 23.

Figure 10:
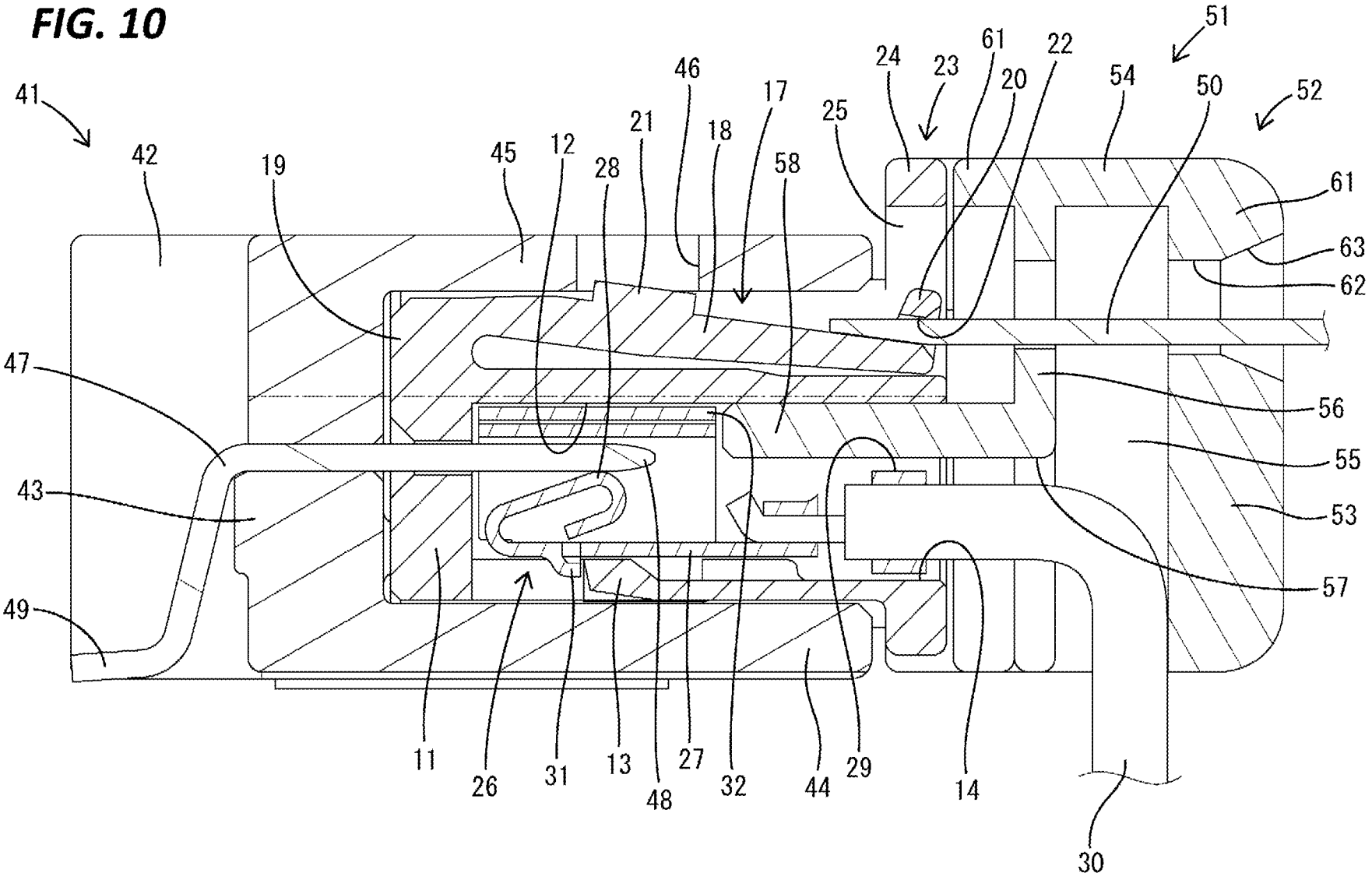
FIG. 10 is a side view in section showing a state where a lock arm is disposed in an unlocking direction by a jig in a connector of a second embodiment.
Figure 11:
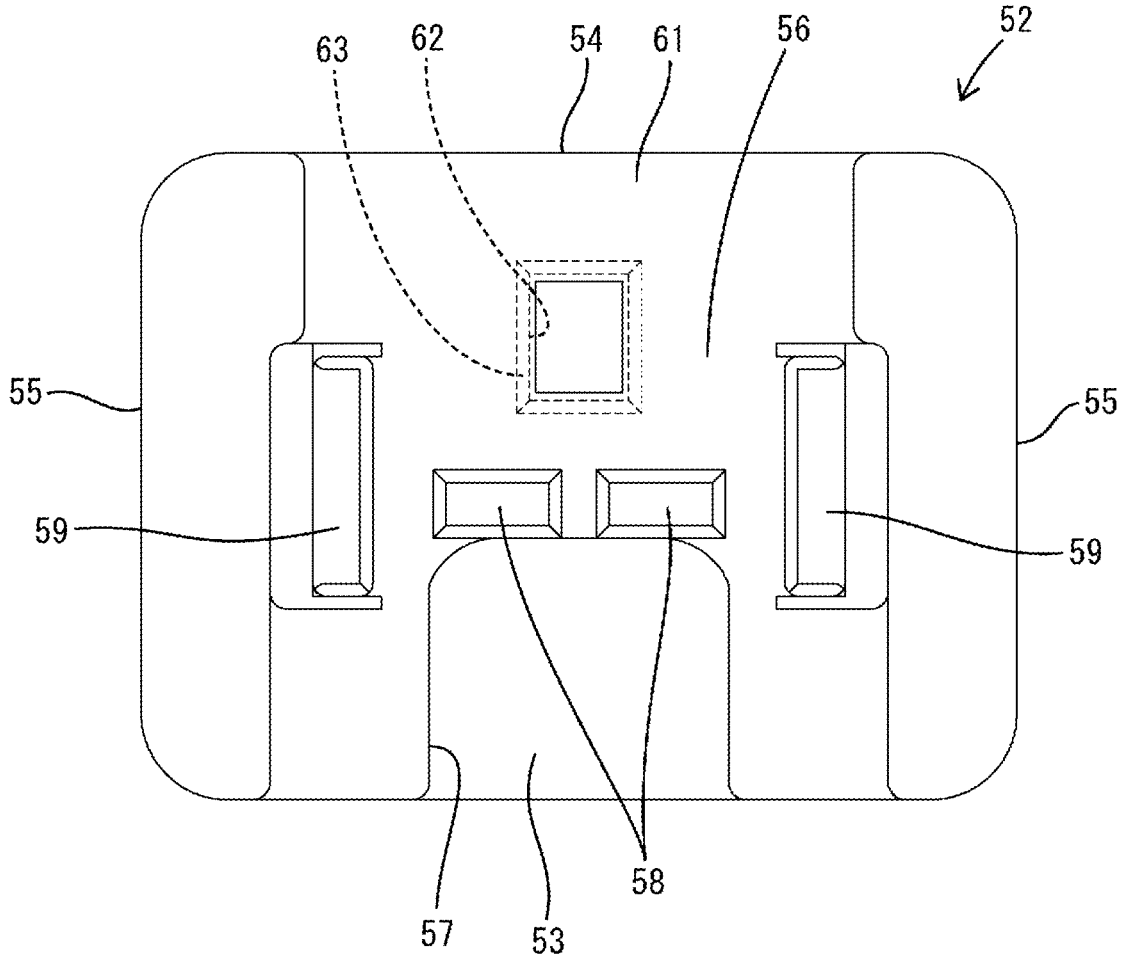
FIG. 11 is a front view of a retainer.
Figure 12:
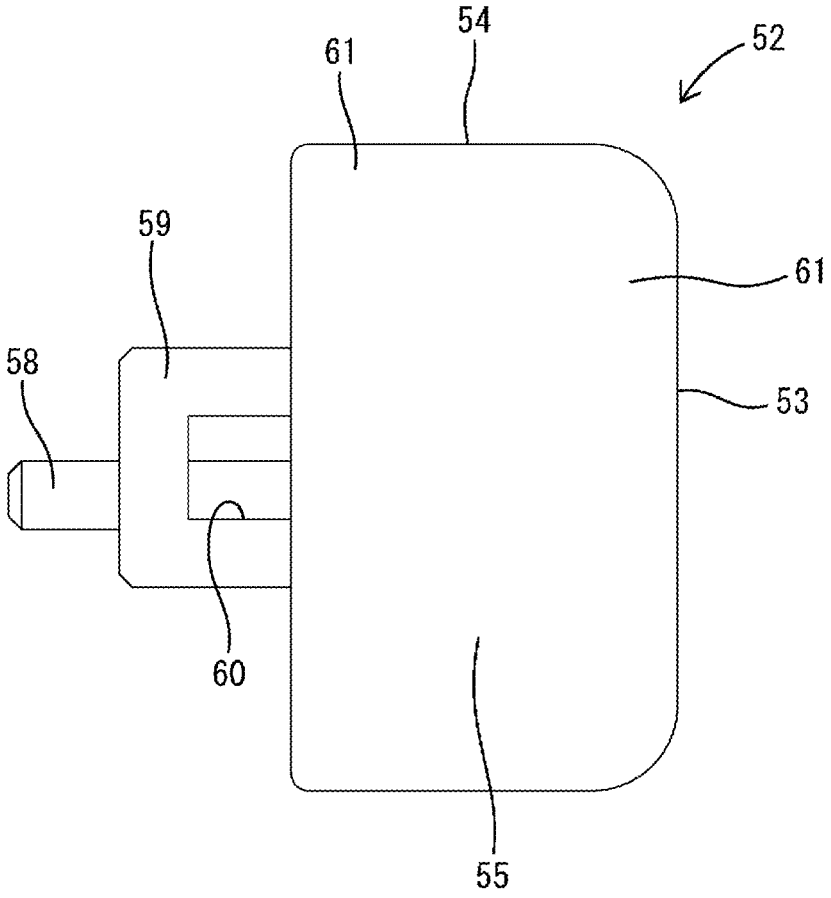
FIG. 12 is a side view of the retainer.
Figure 13:
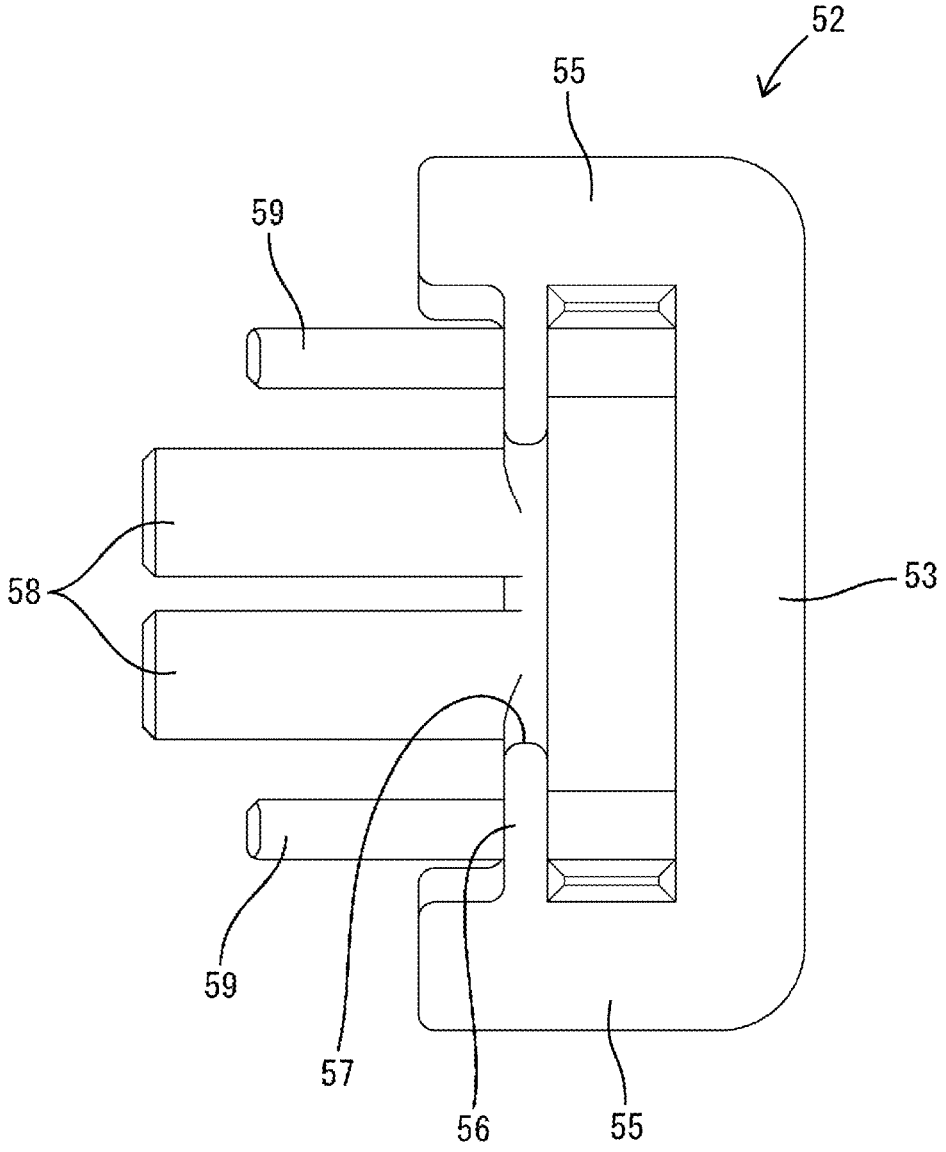
FIG. 13 is a bottom view of the retainer.

In separating a male connector 41 and the female connector 51 in the connected state, the jig 50 is passed through the operating hole 62 from behind the retainer 52 and passed through the inner operating hole 62 and the tip of the jig 50 is inserted into the hooking hole 22 of the operating portion 20. If a tip part of the jig 50 is then displaced downward, the lock arm 17 is resiliently deflected in the unlocking direction as shown in FIG. 10, wherefore a lock projection 21 is disengaged from a lock hole 46 and the locked state of the both connectors 41, 51 is released. Thereafter, the female connector 51 may be pulled out from a receptacle 44 with a lock released state maintained.

In the female connector 51 of the second embodiment, the retainer 52 is formed with the inner wall portion 56 facing the rear surface of the female housing 11 and the outer wall portion 53 located behind the inner wall portion 56, the inner operating hole 64 is formed in the inner wall portion 56 and the outer operating hole 62 is formed in the outer wall portion 53. According to this configuration, the orientation of the jig 50 can be stabilized by the two operating holes 62, 64 including the inner operating hole 64 formed in the inner wall portion 56 and the outer operating hole 62 formed in the outer wall portion 53.

Further, the inner wall portion 56 is formed to face the rear surface of the female housing 11 in the retainer 52. The inner wall portion 56 is formed with the retaining projections 58 and the pair of resilient locking pieces 59. The retaining projections 58 project forward from the inner wall portion 56, and retain the female terminal fittings 26 in the terminal accommodation chambers 12 by coming into contact with the female terminal fittings 26 from behind. The pair of resilient locking pieces 59 project forward from a pair of outer edge parts (both left and right side edge parts) of the inner wall portion 56, and lock the retainer 52 in the state assembled with the female housing 11 by being locked to the locking projections 16 on the outer surface of the female housing 11.

According to this configuration, if the female terminal fitting 26 is pulled rearward to push the retaining projection 58 rearward, the inner wall portion 56 is curved with a laterally central part thereof displaced rearward. As the inner wall portion 56 is curved, front end parts of the pair of resilient locking pieces 59 approach each other and are displaced to be pressed against the outer surface of the female housing 11. In this way, locking margins of the resilient locking pieces 59 and the locking projections 16 increase or locking forces of the resilient locking pieces 59 for locking the locking projections 16 increase. Therefore, there is no possibility that the retainer 52 is separated from the female housing 11, and the female terminal fittings 26 can be reliably retained.

Further, the female housing 11 is formed with the protecting portion 23 circumferentially extending to surround the operating portion 20, and the covering portion 61 is in such a positional relationship as to closely face the rear surface of the protecting portion 23. According to this configuration, it is possible to prevent the interference of an external matter with the operating portion 20 through the clearance between the rear surface of the protecting portion 23 and the front surface of the covering portion 61.

Other Embodiments

The present invention is not limited to the above described and illustrated embodiments. For example, the following embodiments are also included in the technical scope of the present invention.

Although the covering portion covers the operating portion from behind (rear surface side) in the above first and second embodiments, the covering portion may cover the operating portion from an outer peripheral surface side (i.e. from above, below, left or right) or may cover the operating portion from both the rear surface side and the outer peripheral surface side (from above, below, left or right).

Although the lock arm is displaced in the unlocking direction by passing the jig through the operating hole(s) of the retainer in the above first and second embodiments, the operating portion may be operated in the unlocking direction with a finger.

In the above first and second embodiments, an opening or cutout for exposing the lock arm may be formed in the receptacle of the male connector (mating connector) and the lock arm may be displaced in the unlocking direction by the jig passed through this opening or cutout.

Although the covering portion is formed to cover the entire operating portion in a back view in the above first and second embodiments, the covering portion may be formed to cover only a part of the operating portion in a back view.

Although the covering portion is in such a positional relationship as to closely face the rear surface of the protecting portion in the above first and second embodiments, the covering portion may be in such a positional relationship as to come into contact with the rear surface of the protecting portion.

Although the rear member is the retainer for holding the terminal fittings in the retained state by being mounted into the rear end part of the housing in the above first and second embodiments, the present invention can be applied also when the rear member is a member not having a function of retaining terminal fittings (e.g. a dedicated component as a wire cover or the like).

LIST OF REFERENCE NUMERALS

10, 51 female connector (connector)
11 female housing (housing)
12 terminal accommodation chamber
13 locking lance
14 terminal insertion opening
15 guide recess
16 locking projection
17 lock arm
18 arm body portion
19 supporting portion
20 operating portion
21 lock projection
22 hooking hole
23 protecting portion
24 upper surface protecting portion
25 side surface protecting portion
26 female terminal fitting (terminal fitting)
27 rectangular tube portion
28 resilient contact piece
29 crimping portion
30 coated wire
31 primary locking portion
32 secondary locking portion
33, 52 retainer (rear member)
34 wall portion
35,61 covering portion
36 operating hole
37 retaining projection
38 resilient locking piece
39 locking hole
40 escaping recess
41 male connector
42 male housing
43 terminal through portion
44 receptacle
45 upper surface portion
46 lock hole
47 male terminal fitting
48 tab
49 board connecting portion
50 jig
53 outer wall portion
54 side surface wall portion
55 side surface wall portion
56 inner wall portion
57 escaping recess
58 retaining projection
59 resilient locking piece
60 locking hole
62 outer operating hole (operating hole)
63 guiding surface
64 inner operating hole (operating hole)

What is claimed is:

1. A connector, comprising: a housing; a terminal fitting to be inserted into the housing from behind; and a rear member to be mounted into the housing, wherein: the housing includes a lock arm having a rear end part serving as an operating portion for unlocking, and the rear member is formed with a covering portion for covering at least a part of the operating portion, wherein:

the rear member is formed with an operating hole, and the operating hole is formed such that a jig for displacing the operating portion in an unlocking direction is passable therethrough, wherein: the rear member includes an inner wall portion facing a rear surface of the housing and an outer wall portion located behind the inner wall portion, and the operating holes are formed in the inner wall portion and the outer wall portion.

2. The connector of claim 1, wherein:

the rear member functions as a retainer for holding the terminal fitting in a retained state by being mounted into the rear end part of the housing.

3. The connector of claim 1, wherein:

the rear member is formed with a wall portion facing a rear surface of the housing, the wall portion is formed with a retaining projection projecting forward from the wall portion and configured to come into contact with the terminal fitting from behind, and the wall portion is formed with a pair of resilient locking pieces projecting forward from a pair of outer edge parts of the wall portion and to be locked to locking projections on an outer surface of the housing.

4. The connector of claim 1, wherein:

the housing is formed with a protecting portion circumferentially extending to surround the operating portion, and the covering portion is in such a positional relationship as to closely face or come into contact with a rear surface of the protecting portion.

* * * * *